US010843842B2

(12) United States Patent
Yen

(10) Patent No.: US 10,843,842 B2
(45) Date of Patent: Nov. 24, 2020

(54) PACKAGING BOX

(71) Applicant: INTERNATIONAL DESIGN PACKING CO., LTD., Suzhou (CN)

(72) Inventor: Wentai Yen, Suzhou (CN)

(73) Assignee: INTERNATIONAL DESIGN PACKING CO., LTD., Xiancheng District Suzhou (CN)

( * ) Notice: Subject to any disclaimer, the term of this patent is extended or adjusted under 35 U.S.C. 154(b) by 0 days.

(21) Appl. No.: 16/093,142

(22) PCT Filed: Sep. 15, 2017

(86) PCT No.: PCT/CN2017/101817
§ 371 (c)(1),
(2) Date: Oct. 11, 2018

(87) PCT Pub. No.: WO2018/188264
PCT Pub. Date: Oct. 18, 2018

(65) Prior Publication Data

US 2019/0382156 A1 Dec. 19, 2019

(30) Foreign Application Priority Data

Apr. 14, 2017 (CN) ..... 2017 2 0397792 U

(51) Int. Cl.
*B65D 5/50* (2006.01)

(52) U.S. Cl.
CPC ..... *B65D 5/505* (2013.01)

(58) Field of Classification Search
CPC .. B65D 5/5028; B65D 5/5035; B65D 5/5045; B65D 5/5047
USPC ..... 206/591, 594, 521, 814
See application file for complete search history.

(56) References Cited

U.S. PATENT DOCUMENTS 1,791,367 A * 2/1931 McVay ..... B65D 5/505 206/591
2,090,780 A 8/1937 Bonville
2,555,126 A * 5/1951 Greve ..... F25D 3/08 206/545

(Continued)

FOREIGN PATENT DOCUMENTS

CN 201165348 Y 12/2008
CN 101717014 A 6/2010

(Continued)

OTHER PUBLICATIONS

International Search Report and Written Opinion dated Jan. 18, 2018 for PCT/CN2017/101817.

(Continued)

*Primary Examiner* — Jacob K Ackun
(74) *Attorney, Agent, or Firm* — Brown Rudnick LLP

(57) ABSTRACT

A packaging box includes: a box body provided with an opening; an adjusting block disposed inside the box body; and a top cover for fitting with the adjusting block to seal the opening, the top cover is foldable and is connected with one side wall of the box body; inner face of the top cover includes a first section and a second section, the first section is provided with a protruding block, the protruding block is a replaceable protruding block, the second section is not provided with the protruding block, and the second section is fitted with a top surface of the adjusting block.

2 Claims, 1 Drawing Sheet

(56) References Cited

U.S. PATENT DOCUMENTS 2,733,851 A * 2/1956 Van Ness ..... B65D 5/5033 206/521
2,808,978 A 10/1957 Wright et al.
2,847,152 A * 8/1958 Van Antwerpen ... B65D 5/5021 206/448
2,979,246 A * 4/1961 Liebeskind ..... B65D 5/509 206/523
4,148,396 A 4/1979 Gardner
4,240,240 A * 12/1980 Cohen ..... B65B 55/20 206/523
4,241,829 A * 12/1980 Hardy ..... B65D 5/563 206/523
4,339,039 A * 7/1982 Mykleby ..... B65D 81/107 206/523
4,681,225 A * 7/1987 Schuster ..... A45C 3/00 206/426
4,754,880 A * 7/1988 Tehrani ..... B65D 81/113 206/523
5,213,215 A * 5/1993 Prevot ..... B65D 5/509 206/446
5,271,499 A * 12/1993 Van Horssen ..... B65D 81/107 206/335
9,169,059 B2 * 10/2015 Shen ..... B65D 81/107
2015/0114876 A1 * 4/2015 McDonald ..... B65D 81/05 206/591

FOREIGN PATENT DOCUMENTS

| | | | |
|---|---|---|---|
| DE | 488769 | C | 1/1930 |
| DE | 202007006584 | U1 | 8/2007 |
| EP | 2292517 | A1 | 3/2011 |
| JP | H02105812 | U | 8/1990 |
| JP | 2009292482 | A | 12/2009 |
| JP | 2010018337 | A | 1/2010 |

OTHER PUBLICATIONS

Extended European Search Report dated Oct. 15, 2019 for counterpart European Patent Application No. 17902590.3.

* cited by examiner

PACKAGING BOX

CROSS-REFERENCES TO RELATED APPLICATIONS

This application is a national stage application under 35 U.S.C. 371 based on international patent application PCT/CN2017/101817, filed on Sep. 15, 2017 which claims priority to a Chinese patent application No. 201720397792.X filed on Apr. 14, 2017, disclosures of both of which are incorporated herein by reference in their entireties.

TECHNICAL FIELD

The present disclosure relates to the field of packaging technology, and for example to a packaging box.

BACKGROUND

A finished packaging box in the related art generally has fixed accommodating space. Slight changes in volume of a bottle, which matches with the packaging box, will cause shakes of the bottle in the packaging box. How to effectively improve universality of the packaging box becomes a problem which is urgently to be solved.

SUMMARY

A packaging box with higher universality is provided in the present disclosure.

A packaging box includes: a box body provided with an opening; an adjusting block disposed inside the box body; and a top cover for fitting with the adjusting block to seal the opening, the top cover is foldable and is connected with one side wall of the box body; inner face of the top cover includes a first section and a second section, the first section is provided with a protruding block, the protruding block is a replaceable protruding block, the second section is not provided with the protruding block, and the second section is fitted with a top surface of the adjusting block.

Optionally, a length of a first edge of the protruding block is shorter than a length of a first edge inside the box body.

Optionally, the adjusting block is removable from the box body.

Optionally, the adjusting block is integrally formed with the box body.

Optionally, a length of a second edge of the protruding block is the same as a length of a second edge inside the box body.

Optionally, the adjusting block is located at one end of an interior of the box body.

Optionally, the adjusting block is a cuboid and includes a first side face, a second side face, a third side face, a fourth side face and a fifth side face; the first side face of the adjusting block faces to the second section of the inner face of the top cover; the second side face and the third side face of the adjusting block adjacent to the first side face respectively abut against a first internal surface and a second internal surface of the box body on two sides of the opening; the fourth side face of the adjusting block faces to the first side face, the fourth side face is adjacent to a third internal surface of the box body, and the third internal surface of the box body faces to the opening; and the fifth side face of the adjusting block is disposed to face to a cavity inside the box body to be fitted with the box body to restrict shaking of an object placed in the box body.

When the packaging box provided in the present disclosure is used, it is possible to conveniently change the accommodating space of the packaging box by flexibly adjusting the adjusting block and the replaceable protruding block so that the bottle fits in the box body and the reliability and universality of the packaging box are improved.

DETAILED DESCRIPTION

The technical solutions of the present disclosure will be described through an embodiment with reference to accompanying drawings.

Figure 1:
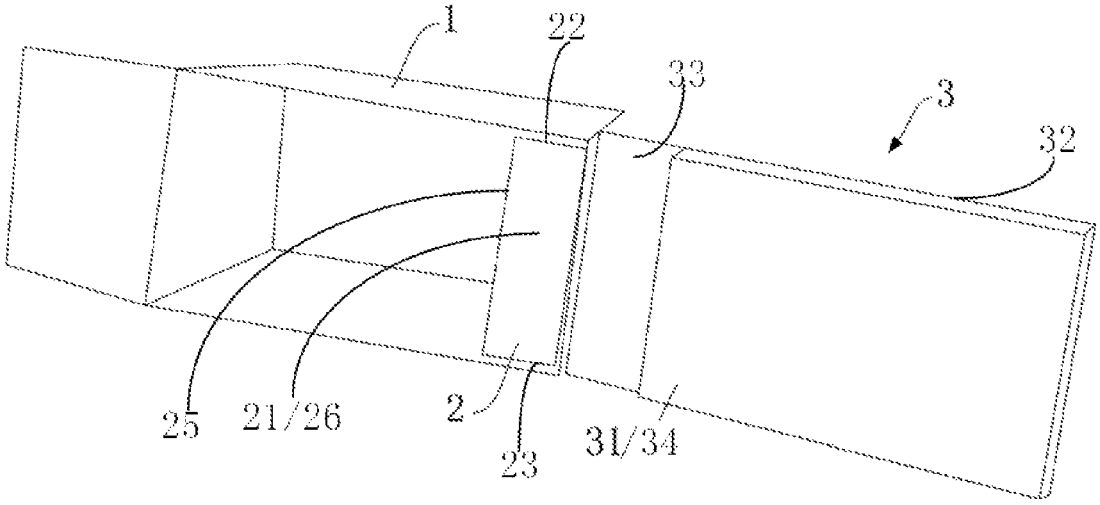
FIG. 1 is a structural view of a packaging box according to an embodiment.

As shown in FIG. 1, a packaging box in the embodiment includes a box body 1 provided with an opening; an adjusting block 2 disposed inside the box body 1; and a top cover 3 for fitting with the adjusting block 2 to seal the opening; the top cover 3 is foldable and is connected with a side wall of the box body 1.

An inner face of the top cover 3 is divided into a first section 32 and a second section 33. The first section 32 is provided with a protruding block 34, the protruding block 34 is a replaceable protruding block 31, the second section 33 is not provided with the replaceable protruding block 31, and the second section 33 is fitted with a top surface 26 of the adjusting block 2. The replaceable protruding block 31 may be a cuboid fixed on the first section 32 of the inner face of the top cover.

The replaceable protruding block 31 may be a cuboid composed of corrugated boards. The size of the protruding block 31 can be changed to match a size of an object placed in the box body 1. For example, when an object exactly matching the size of the box body is placed in the box body, the adjusting block 2 is removed and the replaceable protruding block 31 may have the same size as the opening of the box body, to press the object in the box body tightly and avoid shaking of the object. When there is an interstice in the box body after the object is placed, the adjusting block 2 is placed in the interstice, where the size of the adjusting block 2 matches that of the interstice, the size of the replaceable protruding block 31 may match that of the object, and the adjusting block 2 and the replaceable protruding block 31 are fitted with each other to press the object in the box body tightly and avoid shaking of the object.

Optionally, a first edge of the replaceable protruding block 31 is shorter than a first edge inside the box body.

Optionally, the adjusting block 2 is removable from the box body 1, and the adjusting block 2 and the box body 1 are independent of each other.

Optionally, the adjusting block 2 may also be integrally formed with the box body 1.

Optionally, a second edge of the replaceable protruding block 31 have a same length as the second edge inside the box body.

Optionally, the adjusting block 2 is located at one end of an interior of the box body.

Figure 2:
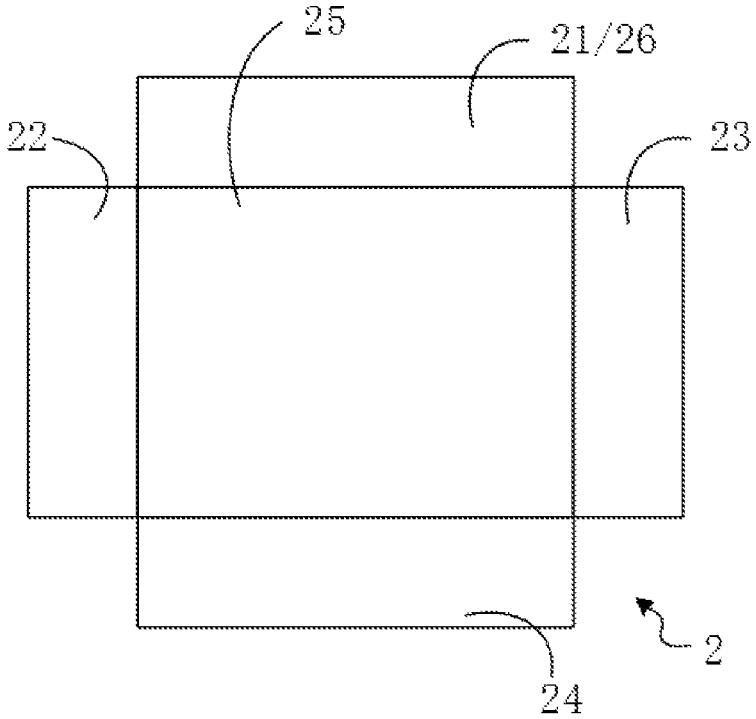
FIG. 2 is a plan view of an adjusting block in an unfolded state according to an embodiment.

As shown in FIG. 2, the adjusting block 2 is a cuboid and includes a first side face 21, a second side face 22, a third side face 23, a fourth side face 24 and a fifth side face 25.

The first side face 21 (i.e., the top surface 26) of the adjusting block 2 is corresponding to the second section 33 of the inner face of the top cover 3, and a length of the first side face 21 is equal to a width of an inner side face of the box body 1 to restrict the position of the adjusting block 2.

The second side face 22 and the third side face 23 of the adjusting block 2, which are adjacent to the first side face 21, respectively abut against a first internal surface and a second internal surface of the box body 1 on two sides of the opening.

The fourth side face 24 of the adjusting block 2 faces to the first side face 21, the fourth side face 24 is adjacent to a third internal surface of the box body 1, and the third internal surface of the box body 1 faces to the opening.

The fifth side face 25 of the adjusting block 2 is disposed to face to a cavity inside the box body 1 to be fitted with the box body 1 to restrict shaking of the object placed in the box body 1.

When the packaging box with the above-mentioned structural design is used, it is possible to flexibly adjust accommodating space of the packaging box by disposing the adjusting block and the replaceable protruding block. That is, when the bottle is smaller than the accommodating space of the box body, it enables the bottle to fit in the box body by disposing the adjusting block and it enables the replaceable protruding block to be fitted with the adjusting block to make the bottle stably and reliably placed in the box body by pressing the replaceable protruding block against the top of the bottle. When the bottle matches the accommodating space of the box body, it is possible to remove the adjusting block and adjust the replaceable protruding block to press it against the top of the bottle so that the bottle is stably and reliably placed in the box body.

The packaging box according to the above-mentioned embodiment can be spread out to a minimum volume after shaping during transportation to guarantee that high transport costs are reduced and packaging boxes are safe while they are transported to users. Well-finished packaging boxes in the existing art are three-dimensional and cannot be spread out, thus causing higher transport costs.

What is claimed is:

1. A packaging box, comprising:

a box body provided with an opening;

an adjusting block disposed inside the box body and located at one end of an interior of the box body; and a top cover for fitting with the adjusting block to seal the opening, wherein the top cover is foldable and is connected with one side wall of the box body;

wherein inner face of the top cover comprises a first section and a second section, the first section is provided with a protruding block, the adjusting block and the protruding block are fitted with each other to press an object in the box body and to avoid shaking of the object, the second section is not provided with the protruding block, and the second section is fitted with a top surface of the adjusting block;

wherein the adjusting block is a cuboid and comprises a first side face, a second side face, a third side face, a fourth side face and a fifth side face; wherein the first side face of the adjusting block is the top surface of the adjusting block, the first side face of the adjusting block faces to the second section of the inner face of the top cover, the second side face and the third side face of the adjusting block adjacent to the first side face respectively abut against a first internal surface and a second internal surface of the box body on two sides of the opening, the fourth side face of the adjusting block faces to the first side face, the fourth side face is adjacent to a third internal surface of the box body, the third internal surface of the box body faces to the opening, and the fifth side face of the adjusting block is disposed to face to a cavity inside the box body to be fitted with the box body to restrict shaking of the object placed in the box body.

2. The packaging box according to claim 1, wherein the adjusting block is removable from the box body.

* * * * *